US007110891B1

(12) United States Patent
Tarr

(10) Patent No.: US 7,110,891 B1
(45) Date of Patent: Sep. 19, 2006

(54) DEGAUSSING VULNERABILITY DISPLAY PROGRAM

(75) Inventor: Paulo Bertell Tarr, Silver Spring, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 805 days.

(21) Appl. No.: 10/292,930

(22) Filed: Nov. 8, 2002

(51) Int. Cl.
*G06T 15/00* (2006.01)

(52) U.S. Cl. ..... 702/38; 345/418; 324/228; 324/261

(58) Field of Classification Search ..... 345/619, 345/441, 418; 324/261, 228; 702/38; 102/402, 102/407, 414; 367/96, 99
See application file for complete search history.

(56) References Cited

U.S. PATENT DOCUMENTS

| | | | | |
|---|---|---|---|---|
| 4,055,121 A | | 10/1977 | Jasperson et al. | 102/414 |
| 4,185,326 A | | 1/1980 | Whittaker | 367/96 |
| 4,648,041 A | * | 3/1987 | Tarr | 324/228 |
| 4,766,385 A | | 8/1988 | Polvani | 324/345 |
| 5,126,669 A | * | 6/1992 | Honess et al. | 324/261 |
| 5,277,117 A | | 1/1994 | Bender et al. | 102/402 |
| 5,313,405 A | * | 5/1994 | Jiles et al. | 702/38 |
| 5,623,524 A | | 4/1997 | Weiss et al. | 367/99 |
| 5,698,813 A | | 12/1997 | Ramsay et al. | 102/407 |
| 6,054,986 A | | 4/2000 | Kato | 715/763 |
| 6,686,917 B1 | * | 2/2004 | Tarr | 345/441 |

* cited by examiner

*Primary Examiner*—Phu K. Nguyen
(74) *Attorney, Agent, or Firm*—Howard Kaiser

(57) ABSTRACT

Magnetic signature measurements are taken at various points corresponding to an original water depth beneath a ship. A computer processor receives and processes (i) this group of measured magnetic signature values and (ii) the designed magnetic signature value the sensing of which actuates the subject magnetic mine, implementing graph display management on a user interface display screen. According to the computer processing, some or all such measured magnetic signature values are extrapolated at different depths each greater than the original depth, thereby yielding several or many groups, each group being of extrapolated magnetic signature values associated with various points corresponding to the same depth, the groups collectively representing a three-dimensional arrangement of extrapolated magnetic signature values associated with various points corresponding to different depths. Each point is characterized as either actuating or non-actuating of the mine, and various perspectives of some or all such characterizations are displayed.

19 Claims, 9 Drawing Sheets

DEGAUSSING VULNERABILITY DISPLAY PROGRAM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to magnetically responsive devices such as magnetic mines, more particularly to methods and apparatuses for evaluating the performance of a ship's degaussing system with respect to threats posed by magnetic mines that are situated in a marine environment.

A mine is an explosive device which is usually concealed either underground or underwater, and which is used primarily by military forces for defensive purposes. Mines typically are self-contained devices which include an explosive capability and a detonator (a firing mechanism for triggering the mine explosion), and which explode when touched by or approached by a target. "Minefields" are areas where mines have been placed. Generally there are two categories of mines, based on their situation, viz., "land mines" and "underwater mines" (synonymously referred to as "water mines," "submarine mines," "sea mines" or "naval mines").

An underwater mine is a mine which is situated in or on water or contiguously with respect to water or which otherwise bears physical or functional relation to a water environment. A typical underwater mine comprises an explosive charge positioned underwater and set to fire in response to the presence of a marine vehicle (e.g., a ship or submarine) in contact therewith or in proximity thereto. Underwater mines are generally laid in the water for purposes of damaging or sinking ships or of deterring ships from entering an area. "Moored mines" are underwater mines having positive buoyancy, typically held below the water surface at a pre-selected depth by a mooring (e.g., cable) attached (e.g., tethered) to an anchor (e.g., on a sea bottom). "Bottom mines" are underwater mines having negative buoyancy and resting on a seabed (e.g., at the bottom of relatively shallow water). "Floating mines" are underwater mines that are not entirely underwater but are visible on the surface.

Underwater mines are triggered either by direct contact or by indirect influence. Typically, when an underwater mine is triggered, an expanding gas sphere caused by the explosion sends shock waves through the water, these shock waves having deleterious effects on the nearby target marine vessel. "Contact mines" are actuated as a result of physical contact between the target ship and the mine's casing or one or more of the mine's appendages (e.g., rods or antennae protruding from the mine's surface). "Influence mines" are actuated either as a result of sensing an "influence field" emanating from the target marine vessel, or as a result of the target marine vessel's intrusion within an "influence field" emanating from the mine. Generally, influence mines sense changes in physical patterns in surrounding water, such as pertaining to magnetic fields ("magnetic mines"), pressure change ("pressure mines") or sound waves ("acoustic mines").

U.S. Navy surface combatant ships are equipped with degaussing systems comprising a set of current-carrying coils which are adjusted to reduce the ship's magnetic field and thereby reduce it's vulnerability to the magnetic mine threat. Currently, performance of U.S. naval combatant degaussing systems is determined by recording the combatant's magnetic field at a Magnetic Silencing Facility (MSR), measuring the peak field, and adjusting degaussing coil currents to reduce this peak field to less than a specified level.

However, magnetic mines do not operate by measuring the peak value of a ship's magnetic field; rather, magnetic mines operate by measuring the rate of change of a ship's magnetic field. In addition, many mines measure the rate of change in the ship's horizontal magnetic fields to determine when to actuate. Current methods for measuring combatant degaussing system performance may not reflect the combatant's actual susceptibility to the magnetic bottom mine threat.

SUMMARY OF THE INVENTION

In view of the foregoing, it is an object of the present invention to provide an improved methodology for assessing the performance of a ship's degaussing system relative to underwater magnetic mine threat.

It is another object of the present invention to provide such a methodology wherein an improvement resides in the concordance of the performance assessment with the mine's designed criterion for actuation thereof.

In accordance with typical embodiments of the present invention, a method is provided for visually representing information pertaining to the threat to a vehicle of a magnetically responsive device of interest. The inventive method comprises the steps of: (a) determining a relationship, in a spatial region, between magnetic signature data and device actuation data; and, (b) effecting a display indicative of the relationship. The magnetic signature data pertains to the vehicle. The device actuation data pertains to the magnetically responsive device.

According to frequent practice of such inventive methodology, the magnetically responsive device is a magnetic mine. The device actuation data is mine actuation data. The magnetic signature data includes plural magnetic field values associated with the vehicle. The magnetic field values correspond to plural locations in the spatial region. Each magnetic field value corresponds to a different location in the spatial region. The mine actuation data includes plural mine actuation criteria associated with the magnetic mine. The actuation criteria correspond to plural locations in the spatial region. Each actuation criterion corresponds to a different location in the spatial region. The determination of a relationship between the magnetic signature data and the mine actuation data includes establishing a correlation, in the spatial region, between the magnetic field values and the mine actuation criteria.

According to typical inventive practice, each actuation criterion is used by the magnetic mine for the purpose of making a threshold determination of whether or not the magnetic mine actuates at that particular location—i.e., a threshold determination of actuation of the magnetic mine versus non-actuation of the magnetic mine at such location. Each actuation criterion includes consideration of at least one influence parameter, at least one of which is a magnetic influence parameter (i.e., pertains to magnetic field or magnetic signature). For instance, each actuation criterion can be based at least in part on a magnetic influence parameter pertaining to the magnetic field rate-of-change value.

Typically according to practice of the present invention, the vehicle is a nautical vehicle. The determination of a relationship between the magnetic signature data and the mine actuation data includes extrapolating plural measured magnetic field values associated with the nautical vehicle so as to obtain plural two-dimensional arrays of extrapolated magnetic field values. Each two-dimensional array corresponds to a different water depth which is greater than an initial water depth. The correlation is between the extrapolated magnetic field values and the mine actuation thresholds, a two-dimensional array of measured magnetic field values having been obtained at the initial water depth. According to some inventive embodiments, the determination of a relationship between the magnetic signature data and the mine actuation data includes obtaining the two-dimensional array of said measured magnetic field values.

In accordance with many embodiments of the present invention, a computer program product comprises a computer useable medium having computer program logic recorded thereon for enabling a computer system to display, on a display screen of said computer system, information pertaining to the vulnerability of a marine vessel to an underwater magnetic mine. The present invention's computer program logic comprises: (a) means for enabling the computer system to extrapolate magnetic signature measurement values, taken at various locations at a selected water depth, so as to obtain a three-dimensional matrix of magnetic signature extrapolation values existing at various locations at various water depths greater than the selected water depth; (b) means for enabling the computer system to relate a magnetic mine model to the three-dimensional matrix of magnetic signature extrapolation values, wherein the magnetic mine model includes a criterion for actuation of a magnetic mine for each of various locations, and wherein at each of various locations the magnetic signature extrapolation value is understood to either satisfy or not satisfy the magnetic mine actuation criterion; and, (c) means for enabling the computer system to render a graphical representation informative of the relation of the magnetic mine actuation criterion to the three-dimensional matrix of magnetic signature extrapolation values. According to typical such embodiments, the computer program logic further comprises means for enabling the computer system to adjust the number of magnetic signature measurement values prior to the extrapolation.

Many inventive embodiments provide apparatus comprising a machine having a memory. The machine contains a data representation pertaining to hazard posed to navigation by a magnetic water mine. The data representation is generated, for availability for containment by the machine, by the method comprising: (a) extrapolating measured magnetic field values to obtain a three-dimensional array of extrapolated magnetic field values; and, (b) associating the three-dimensional array with a model pertaining to actuation of the mine. The measured magnetic field values correspond to a shallowest water depth. The extrapolated magnetic field values correspond to at least two deeper water depths. Each extrapolated magnetic field value is defined as being either one (but not both) of the following: (i) a magnetic field value which does not actuate the mine; and, (ii) a magnetic field value which does actuate the mine (That is, in an exclusively disjunctive manner, each extrapolated magnetic field value is defined as meeting either condition "(i)" or condition "(ii)"). According to typical such embodiments, the inventive apparatus further comprises another machine for graphically representing at least one aspect of the association of the three-dimensional array with the model pertaining to mine actuation.

According to typical embodiments, the present invention's "Degaussing Vulnerability Display Program" enables the rapid determination of the performance of a surface combatant's degaussing system against the magnetic mine threat, with visualization of both the ship's magnetic signature and resulting mine actuation contours. The present invention's degaussing vulnerability display program provides a new metric for measuring degaussing system performance. Using accurate mine models and extrapolation techniques, the inventive program enables degaussing engineers at magnetic silencing facilities to rapidly compute and visualize a surface combatant's vulnerability to the magnetic mine threat. Moreover, the present invention admits of mine threat vulnerability assessment in terms of the specific kind of magnetic field phenomenon (e.g., rate of change of magnetic field) that, according to the design of a given magnetic mine, precipitates actuation of such given magnetic mine.

A "mine model" (also known as a "mine simulation") is a representation of the decision-making process that a particular mine undergoes in order to determine whether or not to actuate under various circumstances. Typically, a mine model is a computer mine model (or computer mine simulation)—e.g., a software simulation of the process that an actual mine uses to determine when to actuate. A mine can use one influence signature, or a combination of plural influence signatures, in the mine's process of determining when to actuate. For example, an acoustic signature can be used together with a magnetic signature in the mine's detection-and-actuation process. Basically, any measurable signature emitted by a passing target can be used in the mine's detection-and-actuation process. For inventive embodiments which are practiced in association with plurally influenced devices, it is assumed that all other (e.g., non-magnetic) influence parameters are satisfied; that is, it is assumed that all influence parameters which are unrelated to the type(s) of influence parameter(s) with which the inventive embodiment is concerned (viz., magnetic influence parameters, which are influence parameters involving magnetic field or magnetic signature) are satisfied.

A magnetic mine model/simulation incorporates data obtained through testing of the magnetic mine of interest. Generally, a mine model/simulation is based upon experimentally obtained data concerning the behavior of the subject mine. The mine is tested by ascertaining how the mine reacts under various circumstances (e.g., at various distances from or locations relative to various stimuli). In particular, investigation involves when the mine actuates and when it does not under various conditions. In this manner, the investigators can rather accurately determine the mine's functional characteristics. The information thus learned can be used for computer modeling (computer simulating) the mine's behavior.

Techniques for testing mines and preparing computer models/simulations are well known in the pertinent arts. For instance, one who is ordinarily skilled in computational sciences (or a related mathematical, scientific or engineering discipline) and who is tasked with computer modeling/simulating a mine's behavior would be capable of applying his or her skill for such assignment. The inventive practitioner(s) may or may not have participated in mine testing and/or mine modelling/simulating; in any event, in the light of the instant disclosure, the inventive practitioner(s) will be capable of practicing the present invention. Ordinarily skilled artisan or artisans who read the instant disclosure will be capable of utilizing a mine model/simulation (e.g., in order to evaluate ship degaussing performance) in accordance with the present invention.

The term "mine model" as used herein refers to any model or simulation of or relating to a mine's behavior. A mine model is typically in computer software form. The term "magnetic mine" as used herein refers to any mine that is influenced by one or more phenomena involving magnetism, regardless of whether and to what extent the mine is influenced by one or more phenomena not involving magnetism (such as involving acoustics or pressure). The term "mine actuation criterion" as used herein refers to the standard, rule or test on which a mine (e.g., in its processing) bases its judgment or decision as to whether or not to actuate. A mine actuation criterion can be characterized by any degree of complexity and can include consideration of any singular or plural number of parameters (factors).

The present invention's degaussing vulnerability display program has several other features and advantages that are consistent with U.S. Navy goals. Firstly, input to the inventive program comes from the binary range data files collected by the U.S. Navy's magnetic silencing facilities; this will enable vulnerability of a ranged combatant to be determined quickly after ranging, either at the magnetic silencing facility or onboard the ranged ship—e.g., simply by copying the data file to a floppy disk and sending the disk to the ship. Furthermore, the inventive program is able to display onset-of-actuation contours at multiple depths in a plan view, allowing the user to select the depth of display. In addition, the inventive program is capable of displaying, in an elevation view, the overall onset-of-actuation curve for all depths at which actuation will occur. Moreover, the inventive program is very easy to use and is interactive, with quick as possible turn-around. Finally, the inventive program has an architecture which will allow new mine models to be added as new mines are exploited and new models developed.

This application bears some relation to the following pending U.S. nonprovisional patent applications, each of which is incorporated herein by reference: Ser. No. 09/746,535, filing date 21 Dec. 2000, (patent application) publication no. 2002/0080138 A1, publication date 27 Jun. 2002, invention entitled "Mine Littoral Threat Zone Visualization Program," sole inventor Paulo Bertell Tarr; Ser. No. 09/721,998, filing date 27 Nov. 2000, invention entitled "Optimal Degaussing Using an Evolution Program," joint inventors Paulo Bertell Tarr and Nevin D. Powell.

Other objects, advantages and features of this invention will become apparent from the following detailed description of the invention when considered in conjunction with the accompanying drawings.

BRIEF DESCRIPTION OF THE APPENDICES

The following appendices, representative of computer code in accordance with the present invention, are hereby made a part of this disclosure:

Attached hereto marked "APPENDIX A" (2 pages) and incorporated herein by reference is a file entitled "dvd4Doc.h.txt," which sets forth header code for the document code set forth in "APPENDIX B."

Attached hereto marked "APPENDIX B" (9 pages) and incorporated herein by reference is a file entitled "dvd4Doc.ccp.txt," which sets forth document code.

Attached hereto marked "APPENDIX C" (4 pages) and incorporated herein by reference is a file entitled "dvd4View.h.text," which sets forth header code for the view code set forth in "APPENDIX D."

Attached hereto marked "APPENDIX D" (63 pages) and incorporated herein by reference is a file entitled "dvd4View.ccp.txt," which sets forth view code.

BRIEF DESCRIPTION OF THE DRAWINGS

In order that the present invention may be clearly understood, it will now be described, by way of example, with reference to the accompanying drawings, wherein like numbers indicate the same or similar components, and wherein:

FIG. 4 is a diagrammatic perspective representation similar to that shown in FIG. 2, particularly illustrating the inventive generation of a three-dimensional magnetic mine vulnerability region (delimited by a three-dimensional mine actuation surface) located beneath the ship, such generation being based on a three-dimensional interrelationship such as shown in FIG. 2.

DETAILED DESCRIPTION OF THE INVENTION

Figure 1:
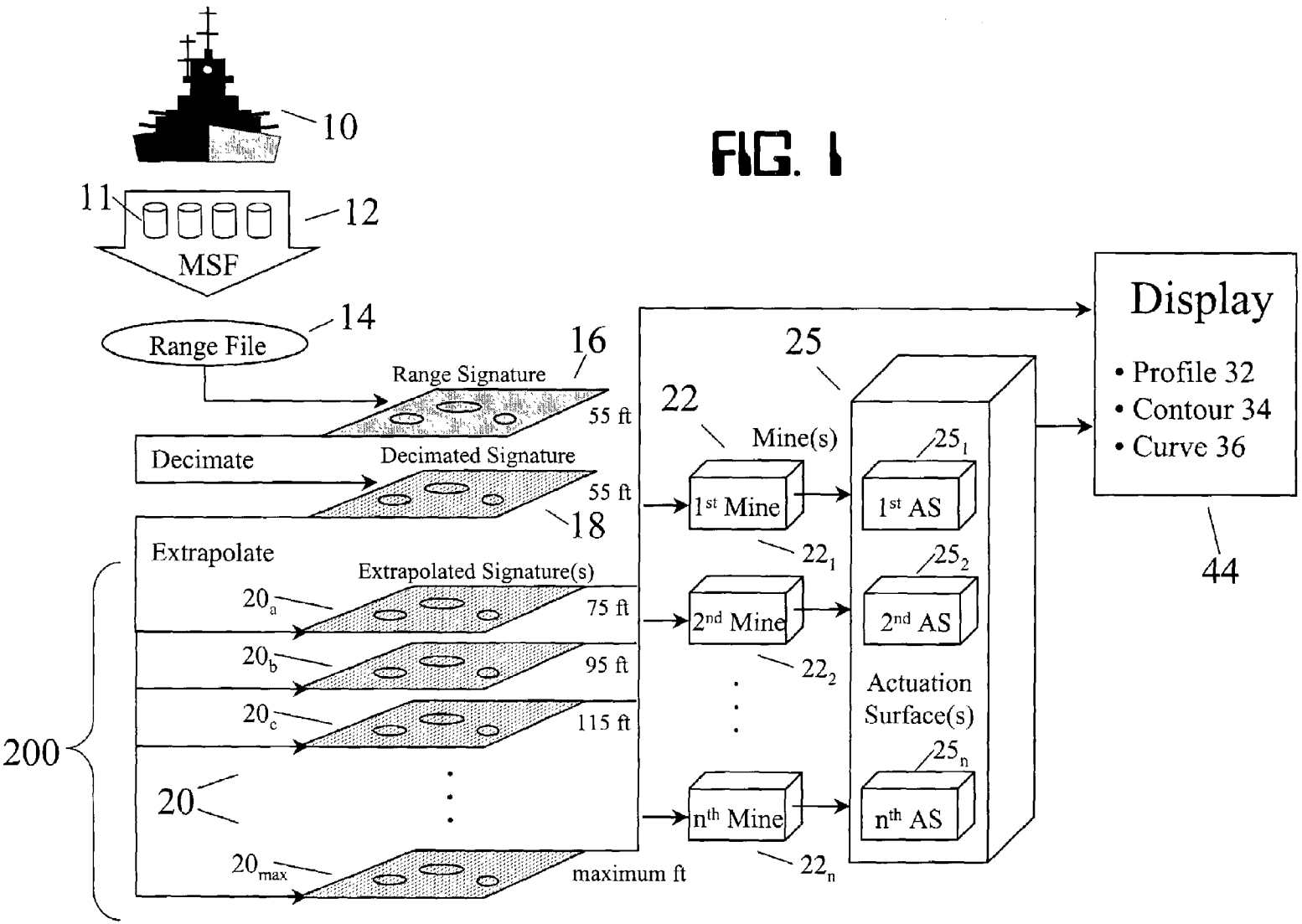
FIG. 1 is a block-and-flow diagram of an embodiment of the "Degaussing Vulnerability Display Program" in accordance with the present invention.
Figure 2:
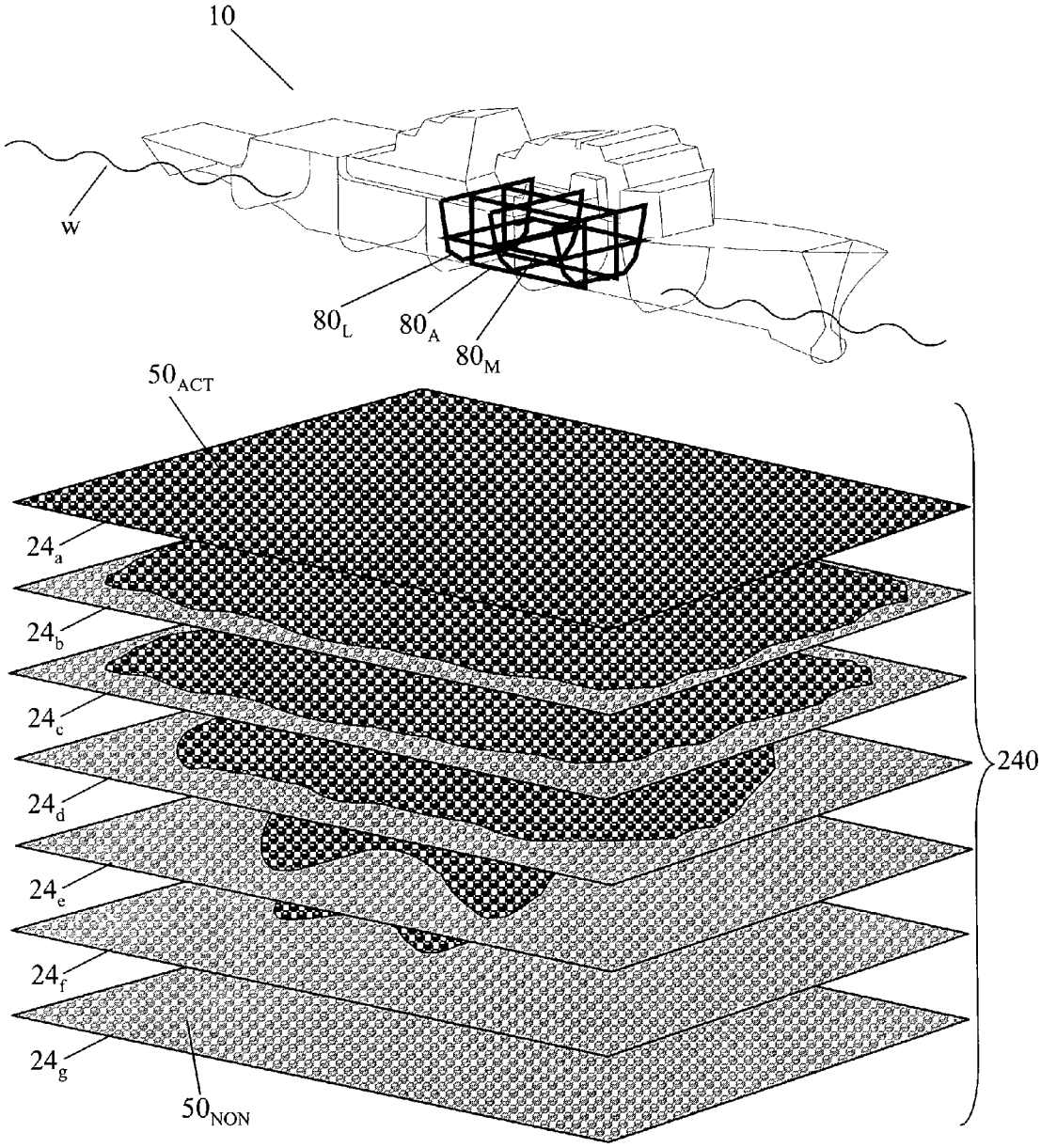
FIG. 2 is a diagrammatic perspective representation of an embodiment of inventive practice in association with a ship such as shown in FIG. 1, particularly illustrating the inventive generation of a three-dimensional interrelationship between (i) calculated magnetic signature extrapolation values and (ii) known actuation characteristics of a given magnetic mine.

Reference is now made to FIG. 1 through FIG. 5. A ship 10 has a degaussing system installed thereon, and is thus equipped with plural L-coils $\mathbf{80}_L$, plural A-coils $\mathbf{80}_A$ and plural M-Coils $\mathbf{80}_M$, such as shown in FIG. 2.

As shown in FIG. 1, ship 10 is "ranged" at a "Magnetic Silencing Facility" ("MSF") 12, using magnetic sensors (e.g., magnetometers) 11. The magnetic field of ship 10 is recorded in a range file 14. The inventive program (the present invention's "Degaussing Vulnerability Display Program") reads the range file 14 into a signature array 16. The inventive program "decimates" signature array 16 to a decimated signature array 18 which is suitable for extrapolation. Signature array 16 and decimated signature array 18 correspond to the same water depth.

When an underwater magnetic mine model 22 is selected, the decimated signature 18 is extrapolated to produce the ship's magnetic signatures 20 at deeper water depths. The extrapolated signatures $\mathbf{20}_a$, $\mathbf{20}_b$, $\mathbf{20}_c$ . . . $\mathbf{20}_{max}$ each represent a planar array of signature values at a particular water depth (e.g., the distance below the water surface w shown in FIG. 2 and FIG. 3), based on the configuration of the magnetic sensors 11 distributed below the ship 10 hull at magnetic sensing facility 12. Each signature 20 is extrapolated from the planar signature array 16 derived from the range file 14 readings, such range file 14 readings having previously been taken (at a magnetic silencing facility 12) at a water depth shallower than that corresponding to any of the extrapolated signatures 20.

As shown in FIG. 1, the combination of all of these signatures at varying water depths represents a three-dimensional array 200 of parallel planar arrays 20. Each two-dimensional array 20 represents a kind of two-dimensional mathematical matrix of magnetic signature values, while the three dimensional array 200 represents a kind of three-dimensional mathematical matrix of magnetic signature values which is the aggregate of the plural two-dimensional arrays 20. Extrapolated signatures 20 are processed in association with a mine model 22, and the resulting actuation contour is stored in the actuation surface 25. If the inventive program is directed to plural mine models 22, each mine model 22 has its own actuation surface 25 associated therewith.

If any mine actuation has occurred at the extrapolation depth, the depth is incremented, the signature is extrapolated at the new depth, the signature is processed with the mine model, and the new actuation contour is added to the actuation surface. This process is repeated until a water depth is reached where actuation does not occur. At this point, all extrapolated signatures are in memory and any profile from any depth can be displayed in the program display 44. The actuation surface is also complete at this point, so the actuation curve and any contour at any depth in the actuation surface can be displayed.

Figure 3:
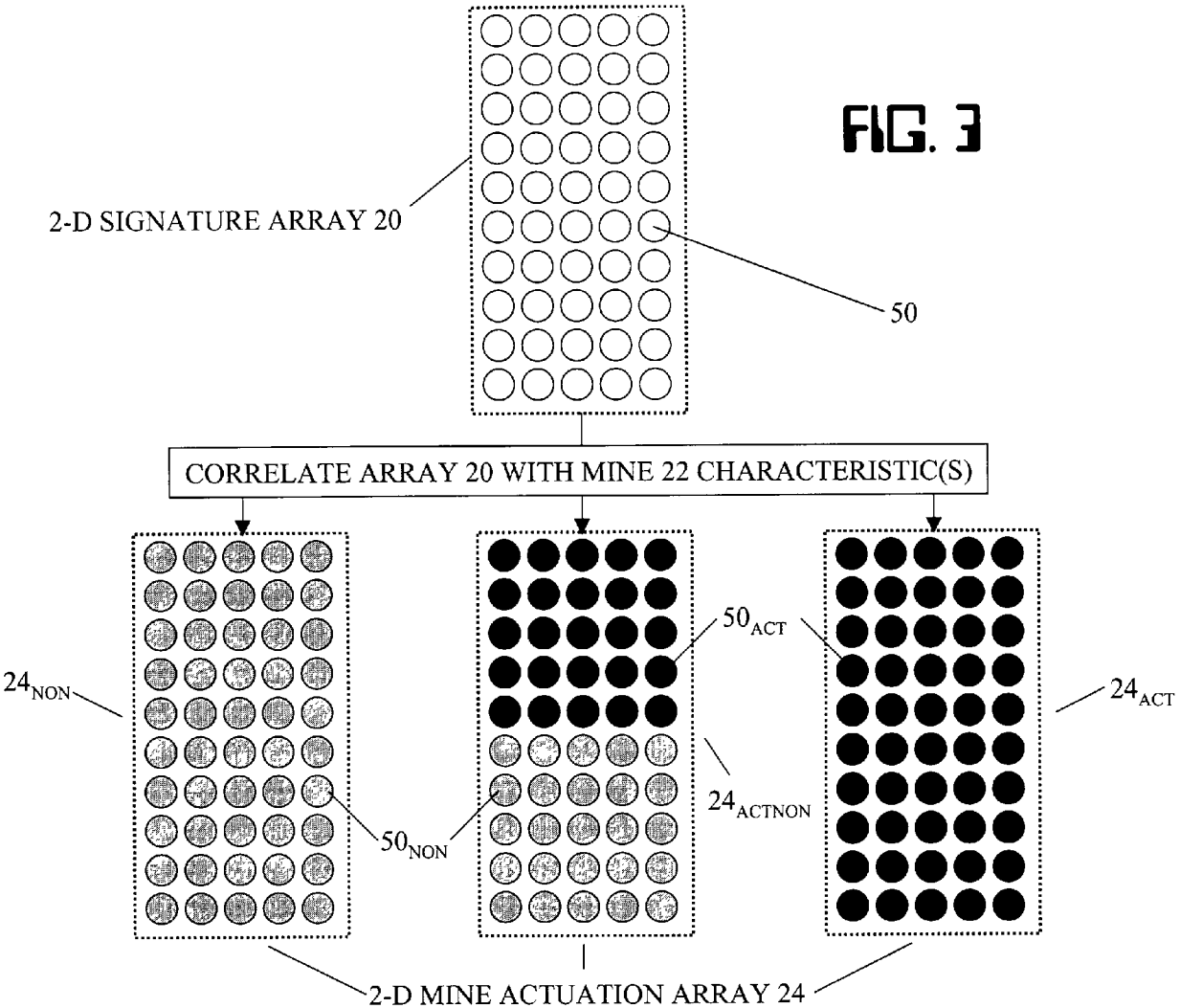
FIG. 3 is a conceptual representation including four two-dimensional arrays (in plan view) arranged in diagrammatical flow format, particularly illustrating how, in accordance with an embodiment of the present invention, a two-dimensional array of extrapolated signature value locations is interrelated with a particular mine's actuation properties so as to yield either actuation or non-actuation of the mine at each location of the two-dimensional array.

Particularly with reference to FIG. 2 through FIG. 4, the inventive program associates the three-dimensional signature array 200 information with the mine model 22 information indicative of the magnetic actuation locations of a particular mine. Each two-dimensional signature array 20 has a mathematical array of signature values, each location 50 having its own corresponding signature value. The magnetic signature array 200 is processed using the mine model 22 to determine actuation surface 25. The inventive program permits an association between these two groups of information in terms of a causal relationship between magnetic signature indicia and mine actuation. Magnetic signature array 200 and mine model 22 are inventively cohered so that, at any given location in the region of interest, a threshold determination is made of whether or not a particular mine model 22 mine is actuated. Regardless of the nature of mine model 22 in terms its mine actuation processing, the present invention can utilize mine model 22 so as to process the magnetic signature 200 information and thereby determine mine actuation locations.

In the world of mine warfare, there are many types of mines having diverse actuation "thought processes." Mine actuation processing varies both in principle and complexity. Each mine's mine model 22 reflect that mine's actuation processing characteristics. For instance, let us take a relatively simple case wherein the actuation of a mine depends only on the rate-of-change (e.g., peak rate-of-change) of the magnetic field; that is, rate-of-change is the only factor (influence parameter) characterizing the mine's actuation processing. Then, the inventive association of mine model 22 with 3-D signature array 200 (which is the combination of individual 2-D signature arrays 20 wherein each location 50 has its own corresponding magnetic field/signature value) involves a less complicated determination of magnetic field rate-of-change at each location; in other words, according to the mine model 22, magnetic field rate-of-change is the only condition that needs to be satisfied in order to result in mine actuation. In this example, at each location 50, mine 22 is characterized by a minimum (threshold) magnetic field value above which (or at or above which) such mine 22 is actuated. Each location 50 is related with mine model 22 in terms of the mine's threshold magnetic field value so as to manifest whether or not this threshold magnetic field value is reached, and hence mine 22 actuates, at such location 50.

As another example, let us take a more complicated case wherein a mine's actuation depends on plural influence parameters, among which is the ship's magnetic field/signature (e.g., rate-of-change); another influence parameter can be, e.g., the ship's acoustic signature. Since there are plural conditions (each condition pertaining to an influence parameter) precedent to mine actuation, the present invention's processing (whereby mine model 22 is used to process 3-D signature array 200 to determine mine actuation locations) must take every such condition into account; hence, for any given location, the inventive processing's determination of mine actuation-versus-non-actuation examines all such conditions and decides whether the magnetic signature information corresponding to such location results in mine actuation. The magnetic signature phenomenon/phenomena will not result in mine actuation unless every other influence parameter condition is satisfied.

Inventive practice can involve any among diverse magnetic and non-magnetic influence parameters. Examples of non-magnetic influence parameters are those involving sound and pressure. Examples of magnetic (magnetic signature/field) influence parameters, any one or more of which can be that influence parameter (or among those influence parameters) which is (are) pertinent to inventive practice, include the following: magnetic field (e.g., peak magnetic field); rate-of-change (e.g., peak rate-of-change) of the magnetic field (e.g., in a segment of the magnetic field); root mean square of the magnetic field; distance of the magnetic field from a desired goal magnetic field. Terms such as "magnetic field value" and "magnetic signature value" are used interchangeably herein, and broadly refer to any physical parameter or parameters that relate to magnetic field or magnetic signature, including but not limited to those mentioned hereinabove. Rate-of-change (e.g., peak rate-of-change) will be an influence parameter for many inventive embodiments.

Upon association of each of the 2-D magnetic field arrays 20 (shown in FIG. 1) with the pertinent magnetic field/signature parameter of a given mine 22, 2-D magnetic field arrays 20 (shown in FIG. 1) become 2-D mine actuation arrays 24 (shown in FIG. 2). That is, upon association of 3-D magnetic field array 200 (shown in FIG. 1) with the pertinent magnetic field/signature parameter of a given mine 22, 3-D magnetic field array 200 (which is a collection of 2-D magnetic field arrays 20, as shown in FIG. 1) becomes 3-D mine actuation array 240 (which is a collection of 2-D mine actuation arrays 24, as shown in FIG. 2). Thus, 2-D magnetic field arrays $\mathbf{20}_a$, $\mathbf{20}_b$, $\mathbf{20}_c$, $\mathbf{20}_d$, $\mathbf{20}_e$, $\mathbf{20}_f$, $\mathbf{20}_g$, . . . become 2-D mine actuation arrays $\mathbf{24}_a$, $\mathbf{24}_b$, $\mathbf{24}_c$, $\mathbf{24}_d$, $\mathbf{24}_e$, $\mathbf{24}_f$, $\mathbf{24}_g$, . . . respectively.

This correlation of the mine 22 actuation value(s) with 3-D magnetic field array 200, thereby forming 3-D mine actuation array 240, is best visualized conceptually in FIG. 3, wherein multiple circles each represent a particular "uncorrelated" location 50 in a particular 2-D magnetic field array 20. Mine model 22 is inventively utilized so as to process the magnetic signature 200 information and determine, based on the mine's design, where such mine is actuated (e.g., explodes). Each uncorrelated location 50 is related with mine 22 in terms of the mine's actuation criterion at such location 50 so as to manifest whether or not this actuation criterion is met (and hence mine 22 actuates) at such location 50. The graphical representation is thus informative in an exclusively disjunctive demarcating fashion, wherein each location manifests either a mine actuation condition or a mine non-actuation condition. Cumulative manifestations, at some or all locations, of this either/or condition can be represented visually using delineation and/or contrasting shading and/or contrasting coloring on the display screen of a computer display 44.

When a given uncorrelated location 50 (shown as an empty circle, or circular outline) of 2-D signature array 20 is correlated with mine 22 actuation information, that location 50 becomes either actuated location $\mathbf{50}_{ACT}$ (shown as a solid black circle) or non-actuated location $\mathbf{50}_{NON}$ (shown as a solid gray circle). Therefore, a given 2-D mine actuation array 24 describes "actuation-versus-non-actuation" of a mine 22, as 2-D mine actuation array 24 can include: (i) all actuated locations $\mathbf{50}_{ACT}$ and no non-actuated locations $\mathbf{50}_{NON}$, as shown in 2-D mine actuation array $\mathbf{24}_{ACT}$; or, (ii) all non-actuated locations $\mathbf{50}_{NON}$ and no actuated locations $\mathbf{50}_{ACT}$, as shown in 2-D mine actuation array $\mathbf{24}_{NON}$; or, (iii) some (one or more) actuated locations $\mathbf{50}_{ACT}$ and some (one or more) non-actuated locations $\mathbf{50}_{NON}$, as shown in 2-D mine actuation array $\mathbf{24}_{ACTNON}$.

Each 2-D mine actuation array 24 is characterized by a two-dimensional pattern of actuated locations $\mathbf{50}_{ACT}$ and/or non-actuated locations $\mathbf{50}_{NON}$. The combination of these individual two-dimensional array actuation-versus-non-actuation patterns yields a three-dimensional "actuation surface" 25 which bounds the three-dimensional "actuation region" 250 of three-dimensional space. Actuation region 250 represents the sum of all locations, relative to ship 10, at which mine 22 will be actuated. Actuation surface 25 represents the outer boundary of this actuation region 250.

Figure 9:
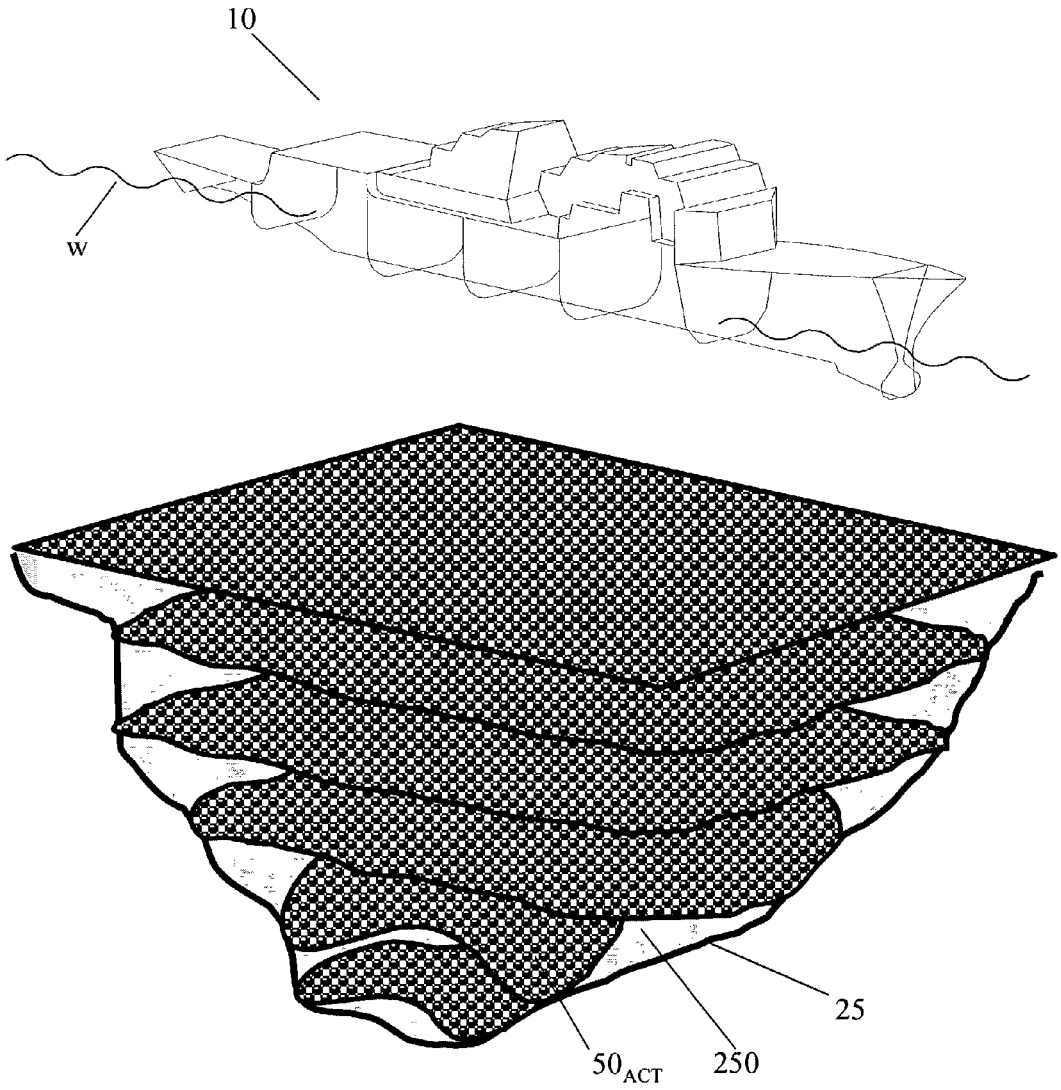
FIG. 9 is the view of the computer user interface shown in FIG. 6, wherein the display window is shown to predominately include an enlarged version of what is essentially the "Actuation Curve" display shown in FIG. 2, such actuation contour display depicting a vertical slice of an actuation surface, such vertical slice extending athwartship (from port to starboard).

The graphical representation shown in FIG. 4 is one of many ways in which, according to the present invention, information indicative of actuation surface 25 (or actuation region 250) can be displayed for human visualization or comprehension. As elaborated upon hereinbelow with reference to FIG. 6 through FIG. 9, the three-dimensional actuation surface 25 (or actuation region 250) can be displayed as a crosswise "slice" in any of multifarious orientations, such as that which is described by the following: (i) existing in a vertical geometric plane oriented longitudinally through the ship 10 at any of various selected locations (e.g., through the centerline) from bow to stern (in a manner akin to that which is shown in FIG. 7); (ii) existing in a vertical geometric plane oriented transversely through the ship 10 at any of various selected locations (e.g., through the midline) from port to starboard (in a manner akin to that which is shown in FIG. 9); or, (iii) existing in a horizontal geometric plane oriented at any of various selected water depths below the ship 10 (in a manner akin to that which is shown in FIG. 8).

Figure 5:
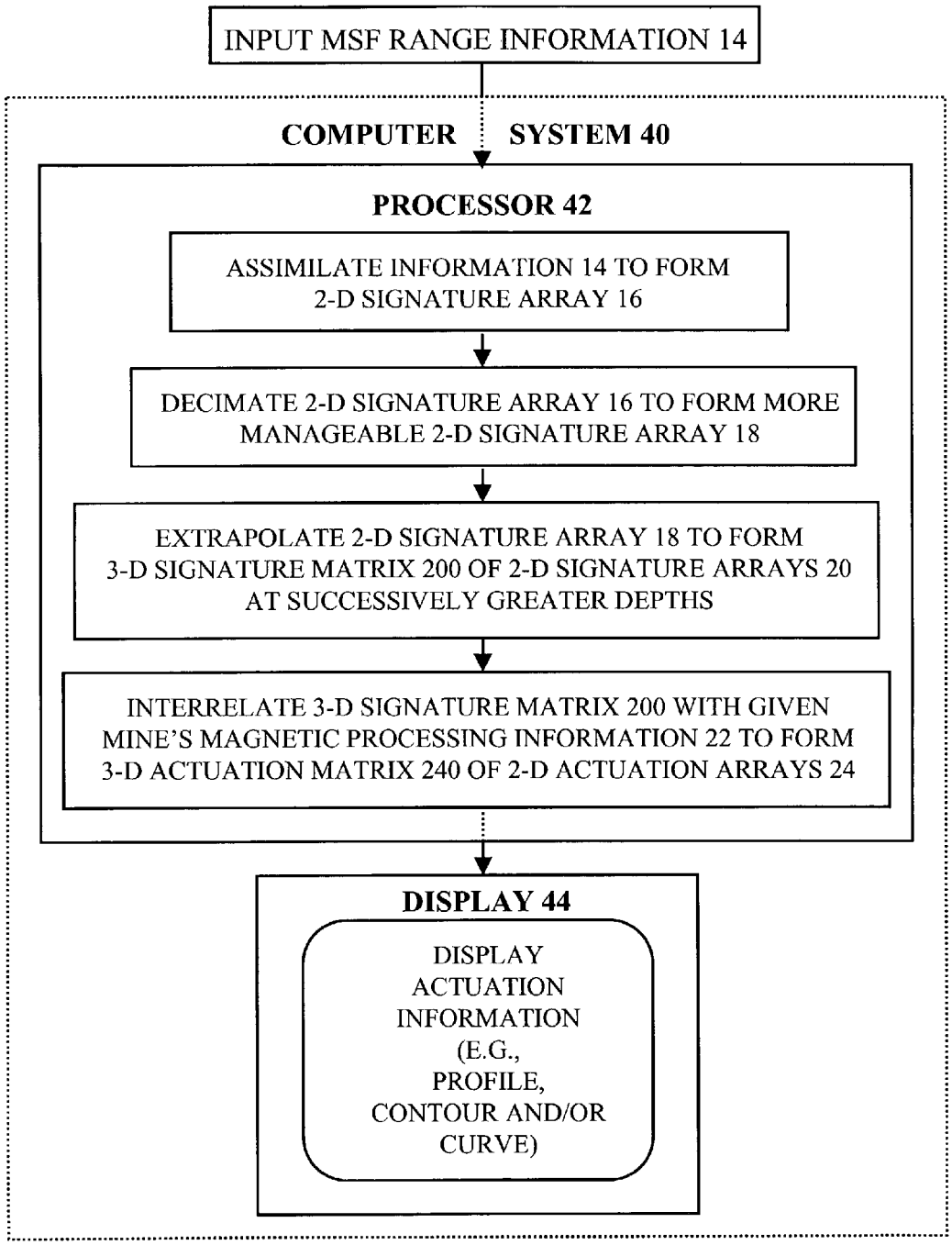
FIG. 5 is a block-and-flow diagram concordant with that shown in FIG. 1, particularly illustrating computer implementation of the present invention.

FIG. 5 facilitates understanding of how the present invention will typically be practiced in association with computer apparatus. Range information 14 is input into computer system 40 that includes processor 42 (which includes a computer memory) and display 44 (which includes a computer user interface). Computer system 40 (in particular, processor 42) uses a computer program product (which includes a recording medium) in accordance with the present invention. In accordance with the inventive program, processor 42: assimilates range information 14 into 2-D signature array 16; decimates 2-D signature array 16 into decimated 2-D signature array 18; extrapolates decimated 2-D signature array 18 into plural extrapolated 2-D signature arrays 20 at various water depths, which together constitute 3-D extrapolated signature array 200; associates 2-D extrapolated signature arrays 20 (i.e., 3-D extrapolated signature array 200) with one or more mine model 22 actuation values, resulting in 2-D actuation arrays 24, which together constitute 3-D actuation array 240. Display 44 displays (e.g., on a display screen) information indicative of the association between extrapolated signature arrays 20 (3-D extrapolated signature array 200) and the mine model 22 actuation value(s).

Computer system 40 can be located onboard ship 10 and/or offboard/ashore, e.g., at a magnetic silencing facility 12. Generally according to inventive practice, there will be a one-to-one correspondence between 2-D extrapolated signature arrays 20 and 2-D actuation arrays 24. Depending on the inventive embodiment, the decimation step can be performed or skipped by processor 42; if such decimation is omitted, processor 42 extrapolates 2-D signature array 16 directly into plural extrapolated 2-D signature arrays 20 at various water depths (which together constitute 3-D extrapolated signature array 200). In accordance with various embodiments of the present invention, the computer system 40 operations can be performed for any number of mine models 22 corresponding to a diversity of mine types.

Figure 6:
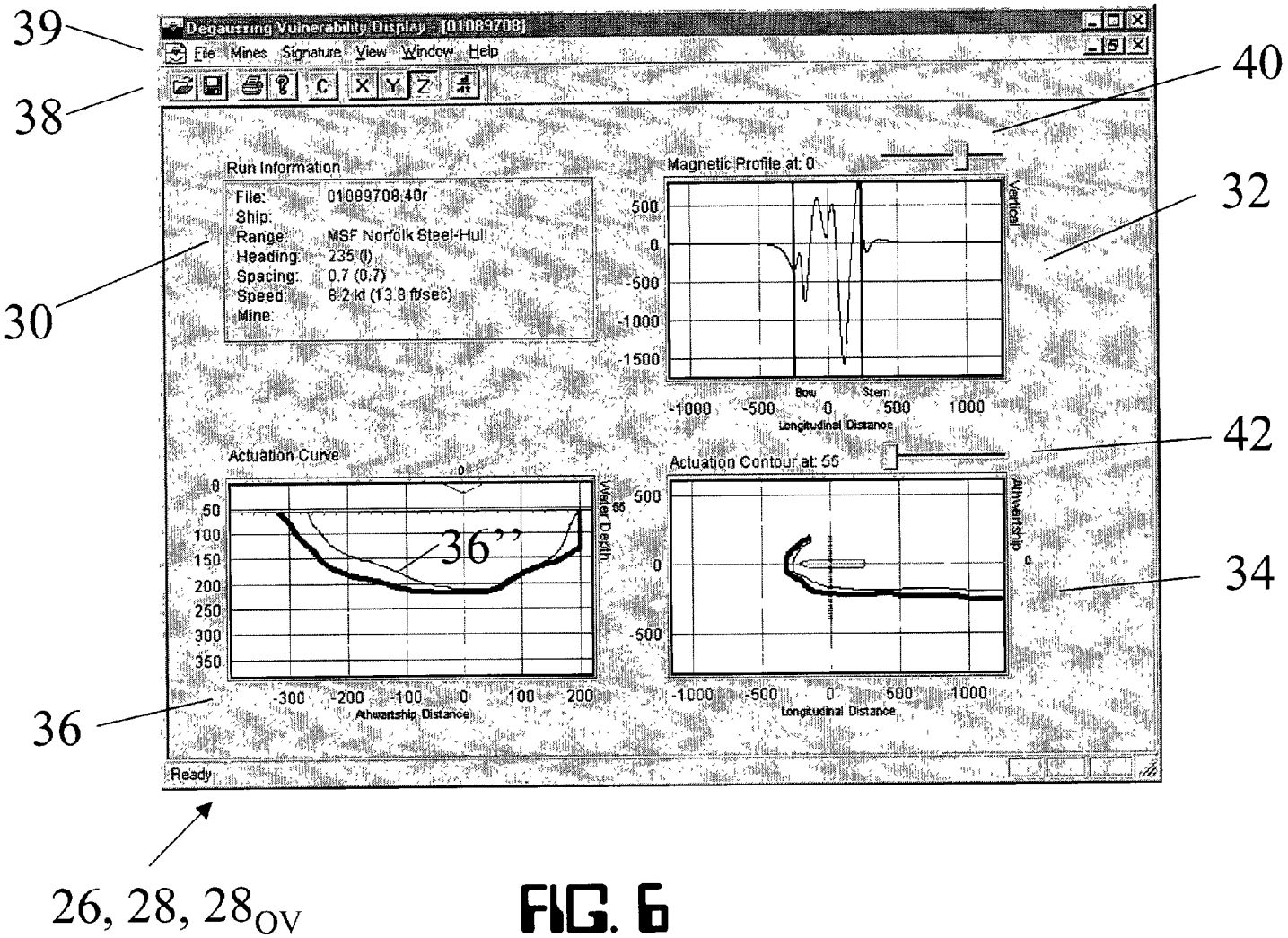
FIG. 6 is a pictorial representation of a computer user interface having an overview display window, wherein the display window is shown to include four visual displays, viz., a "Run Information" display, a "Magnetic Signature Profile" display, an "Actuation Contour" display and an "Actuation Curve" display.
Figure 7:
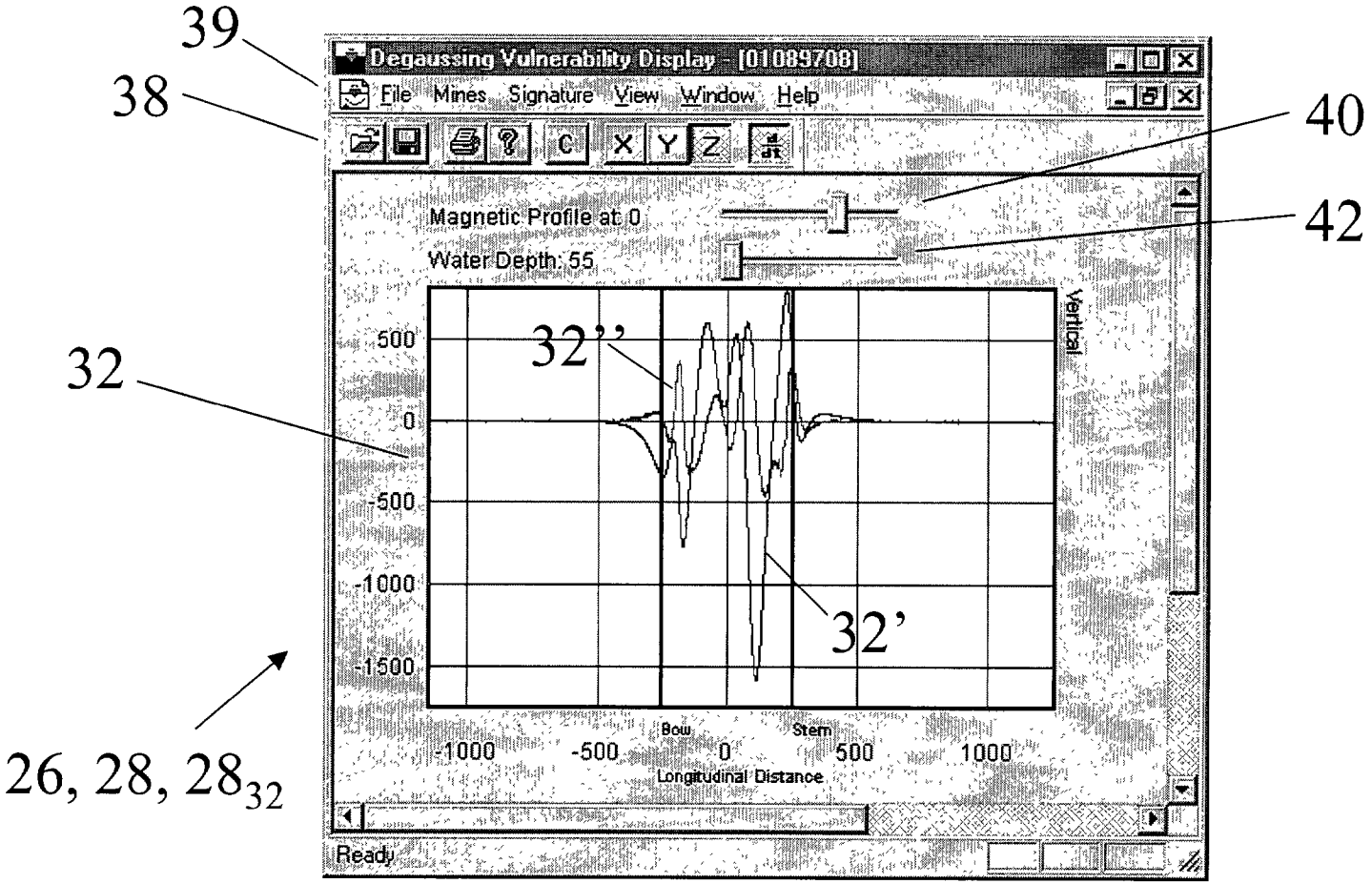
FIG. 7 is the view of the computer user interface shown in FIG. 6, wherein the display window is shown to predominately include an enlarged version of the "Magnetic Signature Profile" display shown in FIG. 6, such magnetic signature profile display depicting a vertical "slice" of the ship's magnetic signature, such vertical slice extending longitudinally (from bow to stern).
Figure 8:
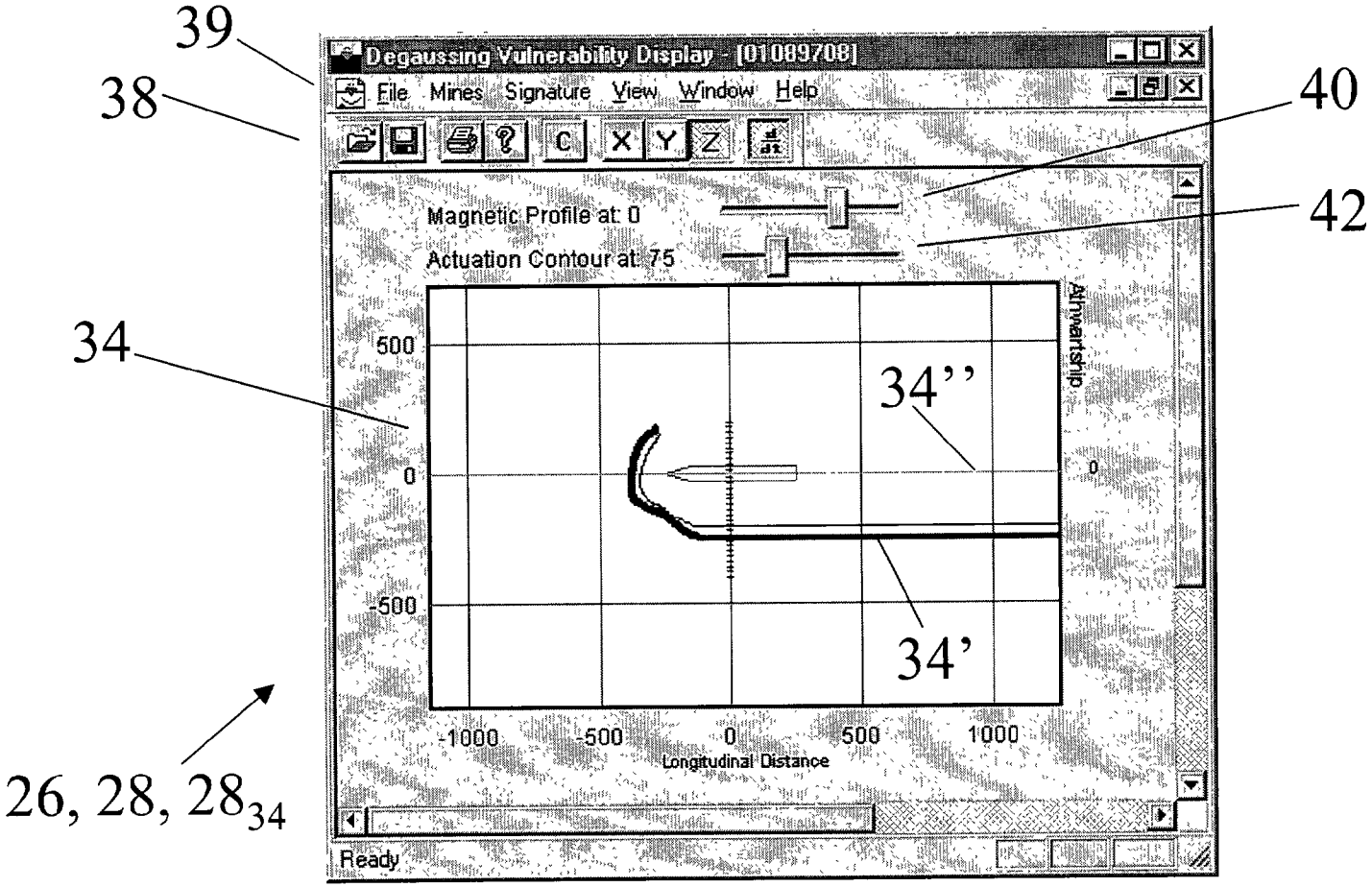
FIG. 8 is the view of the computer user interface shown in FIG. 6, wherein the display window is shown to predominately include an enlarged version of the "Actuation Contour" display shown in FIG. 6, such actuation contour display depicting a horizontal slice of an actuation surface, such horizontal slice extending longitudinally (from bow to stern).
Figure 9:
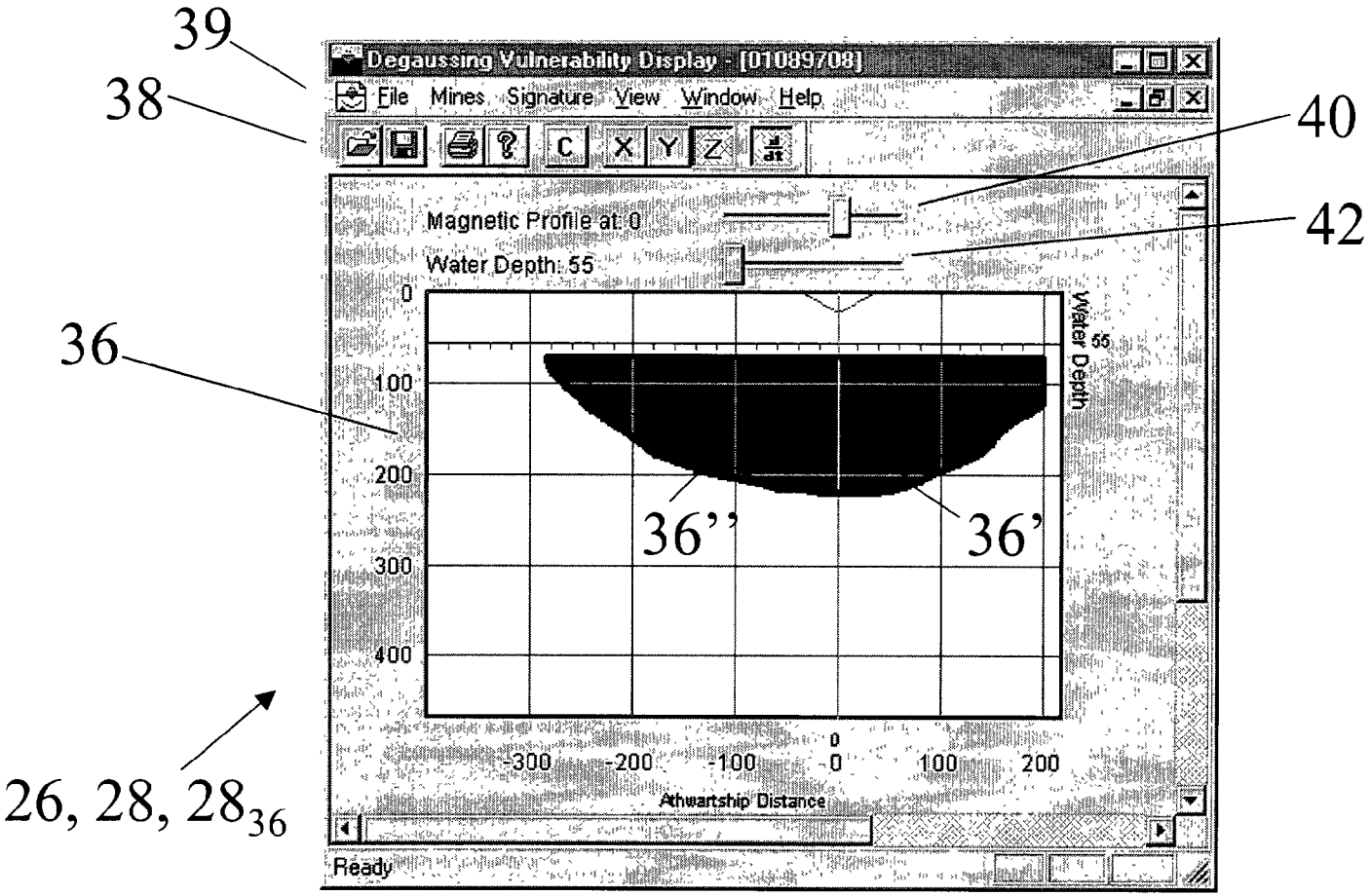

Now with reference to FIG. 6 through FIG. 9, in accordance with a preferred embodiment of the present invention's degaussing vulnerability display program, a display 26 includes a window 28. As shown in FIG. 6, window 28 is the overview display window $\mathbf{28}_{OV}$. Overview display window $\mathbf{28}_{OV}$ is divided into four window display quadrants, viz.: the run information display 30; the magnetic signature profile display 32; the actuation contour display 34; and, the actuation curve display 36.

After the inventive program has been started and a range file selected, the run information is printed in the information display 30, shown in FIG. 6 in the upper left quadrant of overview display window $\mathbf{28}_{OV}$. This information includes filename, ship 10 name, magnetic silencing facility (MSF) 12 at which the file was created, ship 10 heading, longitudinal spacing of the magnetic signature profiles, ship 10 speed and mine type 22.

As shown in FIG. 6 (in the upper righthand quadrant of overview display window $\mathbf{28}_{OV}$) and FIG. 7, the ship's magnetic signature 32' is plotted in the magnetic signature profile display 32, one longitudinal profile at a time. The rate-of-change of the magnetic signature profile can be displayed as well, by selecting "Rate of Change" from the "Signature" menu, or by pressing the d/dt button in the toolbar 38. The rate-of-change 32" is also shown (shown in gray) in the magnetic signature profile display 32.

The magnetic signature component to display (vertical, longitudinal, or athwartship) can be selected from the axis pop-up menu in the signature menu, or by pressing the z, x, or y button in the toolbar 38. Just above the signature profile display 32 is a slider 40, which can be dragged with the mouse to select which signature profile appears in the signature profile display 32. The signature profile display 32 defaults to the keel profile when a file is first opened. Bow and stern locations are, indicated on the signature profile plot, as well as the location of longitudinal mine actuation, if any.

Clicking on the signature profile display 32 in the overview display window $\mathbf{28}_{OV}$ (shown in FIG. 6) zooms it to fill the window 28, window 28 thereby becoming signature profile display window $\mathbf{28}_{32}$ (shown in FIG. 7), which can be resized as desired. Clicking on the zoomed signature profile display 32 in the signature profile display window $\mathbf{28}_{32}$ returns the program's signature profile display window $\mathbf{28}_{32}$ to the overview display window $\mathbf{28}_{OV}$ shown in FIG. 6.

The onset-of-actuation contour display 34 shown in FIG. 8 also appears in the lower righthand quadrant of the present invention's degaussing vulnerability display overview window $\mathbf{28}_{OV}$ shown in FIG. 6. Contour display 34 presents a plan view of the ship 10 and the magnetic silencing range, with ship outline, sensor locations and actuation locations, plotted for the selected depth. A depth slider 42 located just above the contour display 34 can be dragged with the mouse, to select any depths for which extrapolation and actuation have been completed.

The onset-of-actuation contour 34' is displayed as a thick line, and the actuation contour 34" for the selected magnetic signature component (vertical, longitudinal or athwartship) is displayed as a thin line. Clicking on the contour display 34 (in the upper righthand quadrant of overview display window $\mathbf{28}_{OV}$ shown FIG. 6) zooms contour display 34 to fill the window as shown in FIG. 8, and contour display 34 can be resized as desired. Clicking on the zoomed contour display 34 shown in FIG. 8 returns the practitioner to the overview display $\mathbf{28}_{OV}$ shown in FIG. 6.

The onset-of-actuation curve display 36, shown in FIG. 9, also appears in FIG. 6 (sans shading above onset-of-actuation curve 36') in the lower lefthand quadrant of the overview degaussing vulnerability display $\mathbf{28}_{OV}$. Curve display 36 presents an elevation view of the ship and the magnetic silencing range, and extends from the water surface, down to the water depth for which the selected mine no longer actuates. During correlational (associative between signature 20 and mine 22) processing, the onset-of-actuation curve 36' is displayed as a thick line. Once extrapolation and correlational processing have reached a water depth at which the mine 22 does not actuate, correlational processing stops and the onset-of-actuation curve 36' is indicated in the curve display 36 by a filled closed planar geometric figure (e.g., a filled polygon), such as shown in FIG. 9. The actuation curve 36" for the selected magnetic signature component (vertical, longitudinal, or athwartship) is obscured in FIG. 9 but is more clearly displayed in FIG. 6 as a thin black line.

The actuation contour 34 shown in FIG. 8 and the actuation curve 36 shown in FIG. 9 are but two examples of how mine actuation can be visualized in accordance with the present invention. The actuation contour 34 represents a horizontal longitudinal slice of an actuation surface, whereas the actuation curve 36 represents a transverse vertical slice of an actuation surface. According to inventive practice, the actuation surface "slice" (segment) can be oriented any which way. Actuation contour 34 and actuation curve 36 are two preferred orientation modes for rendering humanly comprehensible visuals. Another orientation mode which may be preferable in inventive practice for purposes of showing mine actuation is a longitudinal vertical slice, analogous to that which is depicted in the magnetic signature profile display shown in FIG. 7; it is readily envisioned that a like graph can represent a longitudinal vertical slice of an actuation surface rather than a longitudinal vertical slice of a magnetic signature.

Similarly as may be performed for magnetic profile display 32 and actuation contour 34, the practitioner can: click on actuation curve display 36 and thereby zooms it to fill window 28 (such as shown in FIG. 9); resize actuation curve display 36 as desired; clicking on the zoomed curve display 36 (shown in FIG. 9) to return to the overview display $\mathbf{28}_{OV}$ (shown in FIG. 6).

Prior to processing, the longitudinal spacing of the magnetic signature profile data samples can be changed. This is done from the "Signature" menu, in the longitudinal spacing pop-up menu 39. The initial spacing of the data varies with ship speed and range sampling rate. It is typically less than one foot between data samples in the longitudinal direction. The athwartship spacing depends on sensor spacing, which is twenty feet between sensors at the magnetic silencing facilities.

It is not necessary, albeit often preferable, to decimate range signature 16 array so as to become decimated signature array 18. In other words, according to some inventive embodiments, the decimation step can be omitted, and the extrapolated signatures 20 can be taken directly from the range signature 16. Nevertheless, in order to speed up the extrapolation process, the original range signature 16 data can be decimated by up to eighty-foot spacing between samples. This provides a very quick overview of onset of actuation, but may not be accurate.

For accurate processing, the data needs to be sampled at a rate which provides a good indication of local peak fields and signature shape. Depending upon the complexity of the ranged magnetic signature, this rate will vary, but can be quickly determined by trying different spacing and observing signature profile degradation. For accurate extrapolation, the longitudinal spacing should be no more than twenty feet. The selected spacing is printed in the run information display 30 quadrant of the overview display $\mathbf{28}_{OV}$ shown in FIG. 6.

The depth increment at which extrapolation and correlational mine processing occurs can be changed by selecting the water depth increment pop-up menu from the mines menu. According to this inventive embodiment, water depth increments from five (5) to twenty (20) feet can be selected. A depth increment of twenty feet will result in quicker completion of processing, but the five-foot increment will yield a more detailed actuation curve 32, with more actuation contours 34.

Ship speed can be changed by selecting the "Speed" pop-up menu from the "Mines" menu. According to this inventive embodiment, speeds of five to fifteen knots can be selected. The default speed is the speed at which the ship 10 was ranged at the magnetic silencing facility 12.

Vulnerability computation according to the present invention begins when a mine model 22 is selected from the "Mines" menu. "Version 1.0" of the present invention's "Degaussing Vulnerability Display Program" includes two mine models 22, viz., "FM1" and "FM2." The sensitivity of both mines is set to maximum. When a mine 22 is selected for the first time after opening a binary range file, the magnetic signature is extrapolated to twenty (20) feet below the range depth. The extrapolated magnetic signature 20 is then processed by the selected mine model 22, and the resulting actuation contour 32 is displayed, along with the actuation curve 34, which are each complete only to the extrapolated water depth.

Once mine processing is complete, the water depth is incremented, the magnetic signature is extrapolated to the new depth and processed with the selected mine model 22, and the new actuation contour 32 and actuation curve 34 are displayed. Processing continues in this fashion until a water depth is reached where mine 22 actuation no longer occurs. After this point is reached, all of the extrapolated signatures and actuation contours are in computer memory and can be reviewed by using the mouse to drag the water depth slider 42 (located above the actuation contour display 34) to display the actuation contour 34 and magnetic signature profile 32 at the desired water depth.

During extrapolation and mine processing, a progress box (not shown) appears above the actuation curve display 36, indicating which stage of processing (e.g., the extrapolation stage versus the mine processing stage) the inventive program is in. A stop button is located within the progress box, to enable processing to be interrupted. The display window 28 cannot be closed, and the program cannot be exited, while processing is occurring.

The present invention's degaussing vulnerability display window 28 (whether overview display $\mathbf{28}_{OV}$, magnetic profile display $\mathbf{28}_{32}$, actuation contour display $\mathbf{28}_{34}$ or actuation curve display $\mathbf{28}_{36}$) can be print-previewed and printed out in either portrait or landscape mode, using the "Page Setup," "Print Preview," and "Print" entries in the "File" menu. After processing is complete, the Degaussing Vulnerability Display program contains a set of extrapolated signatures, and an actuation surface for each mine model that has been selected. All of this data can be saved in a "Vulnerability" file, with a ".dvd" extension, using the "Save As" entry in the "File" menu. Once saved, vulnerability files can be reopened for performing additional vulnerability studies at different ship speeds. These follow-on studies will be much quicker than the original processing, as the magnetic signature will not need to be extrapolated again.

The present invention's degaussing vulnerability display program was written by the inventor in the Microsoft® Visual C++® programming language, using the Microsoft Foundation Classes (MFC) and a set of degaussing classes. The MFC are a set of C++ classes which provide an application framework for windows programming in the Windows NT® and Windows 95® operating systems. The degaussing classes are encapsulations of data and algorithms which are commonly used in degaussing software programming.

Reference is now made to APPENDIX A, APPENDIX B, APPENDIX C and APPENDIX D. The computer code set forth in the appendices herein, representative of the present invention's software (written in C++), is characterized by a "document-view" architecture. That is, part of the inventive code handles the data that is involved, e.g., program initialization and data management; this part includes the "document code" and represents the "document" aspect of the inventive code. The other part of the inventive code handles the user interface; this part includes the "view code" and represents the "view" aspect of the inventive code. The inventive code is presented herein in the appendices in four sections, viz.: APPENDIX A, containing the header file for the document code; APPENDIX B, containing the document code file; APPENDIX C, containing the header file for the view code; and, APPENDIX D, containing the view code file.

The degaussing classes used in the design and implementation of the present invention's degaussing vulnerability display program include range data, signature, mine, actuation surface and display classes. The range data class opens a range data file, allocates enough computer memory to hold the data, and reads the data from disk into memory. The signature class holds a triaxial, uniformly sampled magnetic signature comprising multiple longitudinal profiles, and provides methods for decimating and extrapolating the signature, locating the keel profile, and compiling signature statistics. The mine classes encapsulate mathematical mine models which receive uniformly sampled data as input and output mine look and fire signals. The actuation surface class holds mine actuation location information for multiple depths. Finally, the display class encapsulates the data and algorithms necessary to draw the magnetic signature profiles, actuation contours and actuation curves, which are needed or desired for degaussing vulnerability display.

Mathematically, the extrapolation technique used in the inventive computer code embodiment set forth hereinabove, a generally preferred extrapolation technique for practice of the present invention's degaussing vulnerability display program, is known as "the solution of the Dirichlet problem for the plane." This extrapolation technique allows calculation of the three components of the magnetic field of a ship (vertical, longitudinal and athwartship), when the vertical magnetic field has been measured by a magnetic range located between the ship and the calculation depth. This extrapolation technique is accurate at or below a distance equal to the largest spacing used in the data measurement grid. Since the magnetic range sensors are separated by twenty feet, the first extrapolation depth is always twenty feet below the range depth.

Onset of actuation for a particular mine is determined by applying all of the ship magnetic signature profiles to the selected mine model and noting where actuation occurs. The onset-of-actuation contour for a particular depth is determined by forming the union of the actuation contours at that depth, for the vertical, longitudinal and athwartship components of the magnetic signature at that depth. The onset-of-actuation curve is determined by forming the union of the actuation curves for the vertical, longitudinal and athwartship components of the magnetic signature.

Generally, a magnetic mine is a device having a magnetic detection component. Although inventive practice will typically involve magnetic mines, the present invention can be practiced in association with any magnetically responsive (e.g., magnetically actuated or magnetically activated or magnetically sensitive) system or devices, such as magnetic mines and magnetic detectors. Moreover, although inventive practice will more typically be concerned with vulnerability assessment of ships and other surface naval vessels, the present invention can be practiced whether the vehicle in question is a marine vehicle or land vehicle. Furthermore, it is not necessary, according to inventive practice, that the spatial region examined for vulnerability assessment lie entirely or mainly below the vehicle. For instance, a submarine may require vulnerability assessment with regard to magnetic devices located below, beside and/or above the submarine. In the light of the instant disclosure, the ordinarily skilled artisan will be capable of practicing the present invention with regard to diverse vehicles as well as diverse magnetic systems and devices.

Other embodiments of this invention will be apparent to those skilled in the art from a consideration of this specification or practice of the invention disclosed herein. Various omissions, modifications and changes to the principles described herein may be made by one skilled in the art without departing from the true scope and spirit of the invention which is indicated by the following claims.

What is claimed is:

1. A method for visually representing information pertaining to the threat to a vehicle of a magnetic mine of interest, said method comprising:

determining a relationship, in a spatial region, between magnetic signature data and mine actuation data, said magnetic signature data pertaining to said vehicle, said mine actuation data pertaining to said magnetic mine; and effecting a display indicative of said relationship;

said magnetic signature data including plural magnetic field values associated with said vehicle, said magnetic field values corresponding to plural locations in said spatial region, each said magnetic field value corresponding to a different said location in said spatial region;

said mine actuation data including plural mine actuation criteria associated with said magnetic mine, said actuation criteria corresponding to plural locations in said spatial region, each said mine actuation criterion corresponding to a different said location in said spatial region; and said determining a relationship between said magnetic signature data and said mine actuation data including establishing a correlation, in said spatial region, between said magnetic field values and said mine actuation criteria.

2. The method for visually representing information as recited in claim 1, wherein said vehicle is a nautical vehicle, said determining a relationship between said magnetic signature data and said mine actuation data including extrapolating plural measured magnetic field values associated with said vehicle so as to obtain plural two-dimensional arrays of extrapolated magnetic field values, each said two-dimensional array corresponding to a different water depth which is greater than an initial water depth, said correlation being between said extrapolated magnetic field values and said mine actuation criteria, a two-dimensional array of said measured magnetic field values having been obtained at said initial water depth.

3. The method for visually representing information as recited in claim 2, wherein said determining a relationship between said magnetic signature data and said mine actuation data includes obtaining said two-dimensional array of said measured magnetic field values.

4. The method for visually representing information as recited in claim 3, wherein said obtaining said two-dimensional array of said measured magnetic field values includes selecting said measured magnetic field values from among a greater number of originally measured magnetic field values, said originally measured magnetic field values having been obtained at said initial water depth.

5. The method for visually representing information as recited in claim 1, wherein said vehicle is a nautical vehicle, and wherein said determining a relationship between said magnetic signature data and said mine actuation data includes:

performing plural magnetic field measurements at an initial water depth, thereby obtaining a two-dimensional array of plural measured magnetic field values associated with said vehicle; and extrapolating at least some said measured magnetic field values, thereby obtaining plural two-dimensional arrays of extrapolated magnetic field values, each said two-dimensional array corresponding to a different water depth which is greater than said initial water depth, wherein each said magnetic field value is a said extrapolated magnetic field value.

6. The method for visually representing information as recited in claim 5, wherein:

said determining a relationship between said magnetic signature data and said mine actuation data includes decimating a previously obtained set of said measured magnetic field values, thereby obtaining a decimated set of said measured magnetic field values, said decimated set constituting a subset of said previously obtained set of said measured magnetic field values; and said extrapolating at least some said measured magnetic field values includes extrapolating said measured magnetic field values of said decimated set.

7. The method for visually representing information as recited in claim 1, wherein:

each said mine actuation criterion is toward a threshold determination of actuation of said magnetic mine versus non-actuation of said magnetic mine; and each said mine actuation criterion includes consideration of at least one influence parameter, at least one said influence parameter being a magnetic influence parameter.

8. The method for visually representing information as recited in claim 7, wherein:

said determining a relationship between said magnetic signature data and said mine actuation data includes using a computer processor for said establishing of a correlation between said signature magnetic field values and said mine actuation criteria;

said effecting a display indicative of said relationship includes using a computer display for rendering at least one graphical representation indicative of said correlation between said signature magnetic field values and said mine actuation criteria; and at least one said graphical representation communicates information, corresponding to at least some said locations in said spatial region, indicative of actuation of said magnetic mine versus non-actuation of said magnetic mine at each said location.

9. The method for visually representing information as recited in claim 8, wherein at least one said graphical representation manifests at least one demarcation separating at least a portion of said spatial region into at least two sub-regions of said spatial region, wherein at least a first said sub-region represents where said magnetic mine actuates and at least a second said sub-region represents where said magnetic mine does not actuate.

10. The method for visually representing information as recited in claim 9, wherein at least one said graphical representation is a three-dimensional graphical representation of said correlation.

11. The method for visually representing information as recited in claim 9, wherein at least one said graphical representation is a two-dimensional graphical representation of said correlation.

12. The method for visually representing information as recited in claim 11, wherein said two-dimensional graphical representation of said correlation is taken along a geometric plane which traverses said spatial region.

13. The method for visually representing information as recited in claim 12, wherein said two-dimensional graphical representation is oriented in a direction selected from the group consisting of:

horizontal;

vertical and transverse relative to said vehicle; and vertical and longitudinal relative to said vehicle.

14. The method for visually representing information as recited in claim 7, wherein each said actuation criterion includes consideration of a said magnetic influence parameter pertaining to magnetic field rate-of-change.

15. The method for visually representing information as recited in claim 1, wherein said vehicle is a nautical vehicle for navigating a body of water, and wherein said spatial region is situated in said body of water and generally below said vehicle.

16. A computer program product comprising a computer useable medium having computer program logic recorded thereon for enabling a computer system to display, on a display screen of said computer system, information pertaining to the vulnerability of a marine vessel to an underwater magnetic mine, said computer program logic comprising:

means for enabling said computer system to extrapolate magnetic signature measurement values, taken at various locations at a selected water depth, so as to obtain a three-dimensional matrix of magnetic signature extrapolation values existing at various locations at various water depths greater than said selected water depth;

means for enabling said computer system to relate a magnetic mine model to said three-dimensional matrix of magnetic signature extrapolation values, wherein the magnetic mine model includes a magnetic mine actuation criterion for each of various locations, and wherein at each of various locations the corresponding magnetic signature extrapolation value is understood to either satisfy or not satisfy the corresponding magnetic mine actuation criterion; and means for enabling said computer system to render a graphical representation informative of said relation of said magnetic mine actuation criterion to said three-dimensional matrix of magnetic signature extrapolation values.

17. The computer program product according to claim 16, wherein said computer program logic comprises means for enabling said computer system to adjust the number of said magnetic signature measurement values prior to said extrapolation.

18. Apparatus comprising a machine having a memory, said machine containing a data representation pertaining to hazard posed to navigation by a magnetic water mine, said data representation being generated, for availability for containment by said machine, by the method comprising:

extrapolating measured magnetic field values to obtain a three-dimensional array of extrapolated magnetic field values, wherein the measured magnetic field values correspond to a shallowest water depth, and wherein the extrapolated magnetic field values correspond to at least two deeper water depths; and associating said three-dimensional array with a model pertaining to actuation of said mine, wherein each said extrapolated magnetic field value is defined as being one but not both of the following:

a said extrapolated magnetic field value which does not actuate said mine; and a said extrapolated magnetic field value which does actuate said mine.

19. The apparatus as defined in claim 18, wherein said machine is a first machine, and wherein said apparatus comprises a second machine for graphically representing at least one aspect of said association of said three-dimensional array with said model pertaining to actuation of said mine.

* * * * *